United States Patent [19]

Murakami et al.

[11] Patent Number: 4,742,370

[45] Date of Patent: May 3, 1988

[54] DEVELOPING DEVICE WITH TONER DENSITY ADJUSTMENT

[75] Inventors: Reiji Murakami; Kozo Matsuyama, both of Yokohama; Shouji Takano, Kawasaki; Kazutaka Takahashi, Yamato; Koji Yukinaga, Tokyo; Motohiko Tanigawa, Kawasaki, all of Japan

[73] Assignee: Kabushiki Kaisha Toshiba, Kawasaki, Japan

[21] Appl. No.: 932,345

[22] Filed: Nov. 19, 1986

[30] Foreign Application Priority Data

Mar. 29, 1986 [JP] Japan ..... 61-72177

[51] Int. Cl.[4] ..... G03G 15/00

[52] U.S. Cl. ..... 355/3 DD; 355/14 D

[58] Field of Search ..... 355/14 D, 3 DD

[56] References Cited

U.S. PATENT DOCUMENTS

| | | | |
|---|---|---|---|
| 3,876,106 | 4/1975 | Powell et al. | 355/14 D |
| 3,892,672 | 7/1975 | Gawron | 355/3 DD |
| 3,932,034 | 1/1976 | Takahashi | 355/3 DD |
| 4,155,638 | 5/1979 | Blitzer | 355/14 D |
| 4,200,388 | 4/1980 | Hasebe et al. | 355/3 DD |
| 4,200,665 | 4/1980 | Suzuki et al. | 355/14 D |
| 4,210,864 | 7/1980 | Miyakawa et al. | 355/3 DD |
| 4,240,375 | 12/1980 | Terashima | 355/3 DD |
| 4,241,696 | 12/1980 | Huzii | 355/14 D |
| 4,273,843 | 6/1981 | Fujita et al. | 355/3 DD |
| 4,276,854 | 7/1981 | Fujita et al. | 355/3 DD |
| 4,321,886 | 3/1982 | Azuma | 355/3 DD |
| 4,338,019 | 7/1982 | Terashima et al. | 355/3 DD |
| 4,431,300 | 2/1984 | Snelling | 355/3 DD |
| 4,451,135 | 5/1984 | Okumura | 355/3 DD |
| 4,460,267 | 7/1984 | Ogawa | 355/3 DD |
| 4,506,973 | 3/1985 | Ernst | 355/3 DD |
| 4,550,998 | 11/1985 | Nishikawa | 355/14 D |
| 4,582,415 | 4/1986 | Hyodo et al. | 355/14 D |
| 4,592,645 | 6/1986 | Kanai et al. | 355/14 D |
| 4,607,933 | 8/1986 | Haneda et al. | 355/14 D |
| 4,615,606 | 10/1986 | Nishikawa | 355/14 D |
| 4,650,310 | 3/1987 | Hayashida et al. | 355/14 D |
| 4,669,856 | 6/1987 | Yamada | 355/3 DD |
| 4,671,646 | 6/1987 | Florack et al. | 355/14 D |

*Primary Examiner*—Patrick R. Salce
*Assistant Examiner*—J. Starrett
*Attorney, Agent, or Firm*—Cushman, Darby & Cushman

[57] ABSTRACT

Disclosed is a developing device, which develops an electrostatic latent image by applying a toner thereto. The device is provided with an auto-toner adjuster, which detects the toner content of a developing agent, and resupplies the toner in accordance with the detected value, thereby keeping the toner content constantly at a predetermined value. At the shipment from the factory, the developing device is sealed hermetically, storing the developing agent used in setting the toner content by the toner adjuster.

15 Claims, 5 Drawing Sheets

DEVELOPING DEVICE WITH TONER DENSITY ADJUSTMENT

BACKGROUND OF THE INVENTION

The present invention relates to a developing device for supplying a toner to an image carrier, with an electrostatic latent image thereon, to develop the latent image, and more specifically to a method of packing a developing device at the time of shipment from the factory, and the packed developing device.

In image forming apparatuses, such as electronic copying machines, an electrostatic latent image is formed on a photosensitive drum, and a powder toner is applied to the latent image, thereby developing the image. After the development, the toner image is transferred to a paper sheet so that an image is formed on the sheet.

In the image forming apparatuses of this type, a developing agent of the so-called two-component type may sometimes be used, which is formed of a mixture of a powder toner and a carrier for carrying the toner. When using the two-component developing agent, the density of a developed image varies, depending on the mixture ratio between toner and carrier. In order to obtain a developing-agent image with a constant or stable density, therefore, the mixture ratio must be kept constant. Since the toner is consumed in the developing process, the toner content (or mixture ratio between toner and carrier) of the developing agent varies gradually. Accordingly, the developing device of this type is provided with an auto-toner adjuster, which automatically detects the mixture ratio between toner and carrier, and supplies the toner in response to a detection signal, during copying operation.

The auto-toner adjuster is designed, however, so as to directly detect the toner-carrier mixture ratio, on the basis of a detected value of the permeability of the developing agent, the quantity of light reflected by the toner only, etc. It is therefore necessary to set some reference values (initial adjustment).

Conventionally, the initial adjustment of the developing device is performed in accordance with the developing agent used, by a serviceman, who visits the user and installs the image forming apparatus, after the apparatus is delivered to the user. This is done because the developing agent, whose properties vary delicately with lots, requires an initial adjustment for each lot.

The initial adjustment, however, requires much labor, by a skilled technician. If the image forming apparatus is operated without the initial adjustment, or if the adjustment is performed in an improper manner, this will cost more time and labor. If the initial adjustment is skipped, in particular, a blade will be rubbed directly against a developing roller in the developing device, so that the blade or photosensitive drum will possibly be damaged.

If the auto-toner adjuster is regulated at the factory, before the shipment of the image forming apparatus, the developing agent, used for the adjustment, cannot be kept stored in the developing device when the apparatus is shipped. The reason is that if the image forming apparatus is shipped with the developing agent in the developing device, the agent will be spilled, by vibration during transport, from a feed port, through which it is to be fed to the photosensitive drum of the apparatus.

SUMMARY OF THE INVENTION

The object of the present invention is to provide a developing device, capable of preventing improper operation, and requiring less labor at the time of unpacking for use, and a method for packing the device.

According to an aspect of the present invention, there is provided a developing device which supplies a toner to an image carrier, having an electrostatic latent image thereon, thereby developing the latent image, which comprises a casing stored with a developing agent, containing the toner and a carrier at a predetermined ratio, and having a feed port through which the developing agent is fed to the image carrier; automatic toner-content adjusting means for keeping the toner content of the developing agent in the housing constant, the adjusting means including content detecting means, adapted to detect the toner content of the developing agent and deliver a detection signal, and replenishing means for resupplying the toner, so as to maintain a preset toner content, in response to the detection signal from the detecting means; and sealing means, for sealing the feed port of the casing, after the casing is loaded with the developing agent used in setting the automatic toner-content adjusting means to the preset toner content.

DETAILED DESCRIPTION OF THE PREFERRED EMBODIMENT

An embodiment of the present invention will be described in detail with reference to the accompanying drawings in FIGS. 1 to 8.

Figure 1:
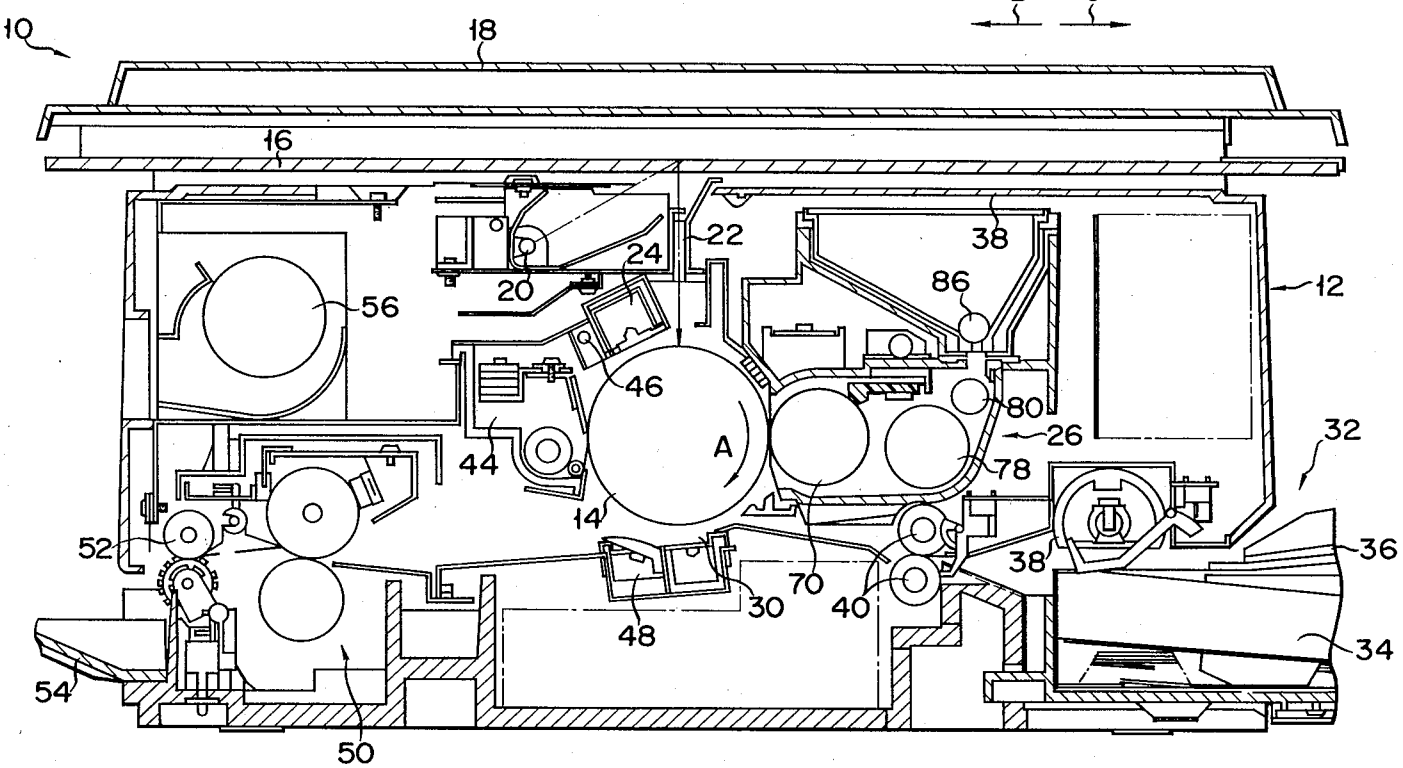
FIG. 1 is a schematic sectional view of an image forming apparatus, using a developing device according to an embodiment of the present invention.

In copying machine 10 as an image forming apparatus, as shown in FIG. 1, photosensitive drum 14, for use as an image carrier, is located substantially in the center of housing 12. During copying operation, drum 14 rotates in the direction indicated by arrow A.

Original table 16, made of transparent glass, is provided on top of housing 12. Supporting an original thereon, it can reciprocate in the directions of arrows B and C. Original cover 18 is hinge-mounted on table 16. As table 16 is moved in synchronism with the rotation of photosensitive drum 14, a light emitted from exposure lamp 20 is reflected by the original on table 16. The reflected light is projected on the peripheral surface of drum 14 by convergent-light transmitter 22, such as a rod lens. Meanwhile, the surface of drum 14 is charged with electricity, by main charger 24. When the light is applied to the drum surface, charged in this manner, an electrostatic latent image is formed on the surface. A toner is attached to the latent image, to form a toner image, by developing device 26 which faces the peripheral surface of drum 14.

Developing device 26 is removably attached to housing 12, so that it can be replaced with another developing device which contains a developing agent of another color. In loading or unloading the developing device, lid 28, hinge-mounted at the top portion of housing 12, is lifted.

Paper feed unit 32 is removably attached to the lower right side of housing 12, as shown in FIG. 1. It serves to feed paper sheets to image-transfer section 30, under photosensitive drum 14. The feed unit is fitted with paper cassette 34, storing a plurality of sheets, and sheet-bypass guide 36 for manual paper feed, located on top of cassette 34. Further, unit 32 is provided with paper-supply roller 38, used to deliver the sheets from cassette 34, and a pair of aligning rollers 40, whereby each delivered sheet is stopped temporarily. Rollers 40 serve to align the leading edge of the sheet, and time the sheet feed to the transport of the toner image, on the peripheral surface of drum 14.

The sheet, transported by aligning rollers 40, is delivered to image-transfer section 30. Thereupon, it is brought closely into contact with the surface of photosensitive drum 14, by transfer charger 42. As the sheet is then charged by charger 42, the toner image on drum 14 is transferred to the sheet. After the transfer, drum 14 is cleared of the residual toner on its surface by cleaner 44, and a residual image is removed by discharge lamp 46, whereupon an entire cycle of copying operation is completed . The sheet, after the transfer, is separated from drum 14 by separation charger 48, and fed to fixing unit 50. As the sheet passes unit 50, the toner image, transferred thereto, is fixed thermally. After the fixation, the sheet is discharged into tray 54 via exit rollers 52. In FIG. 1, numeral 56 designates a cooling fan for preventing a temperature rise.

Figure 2:
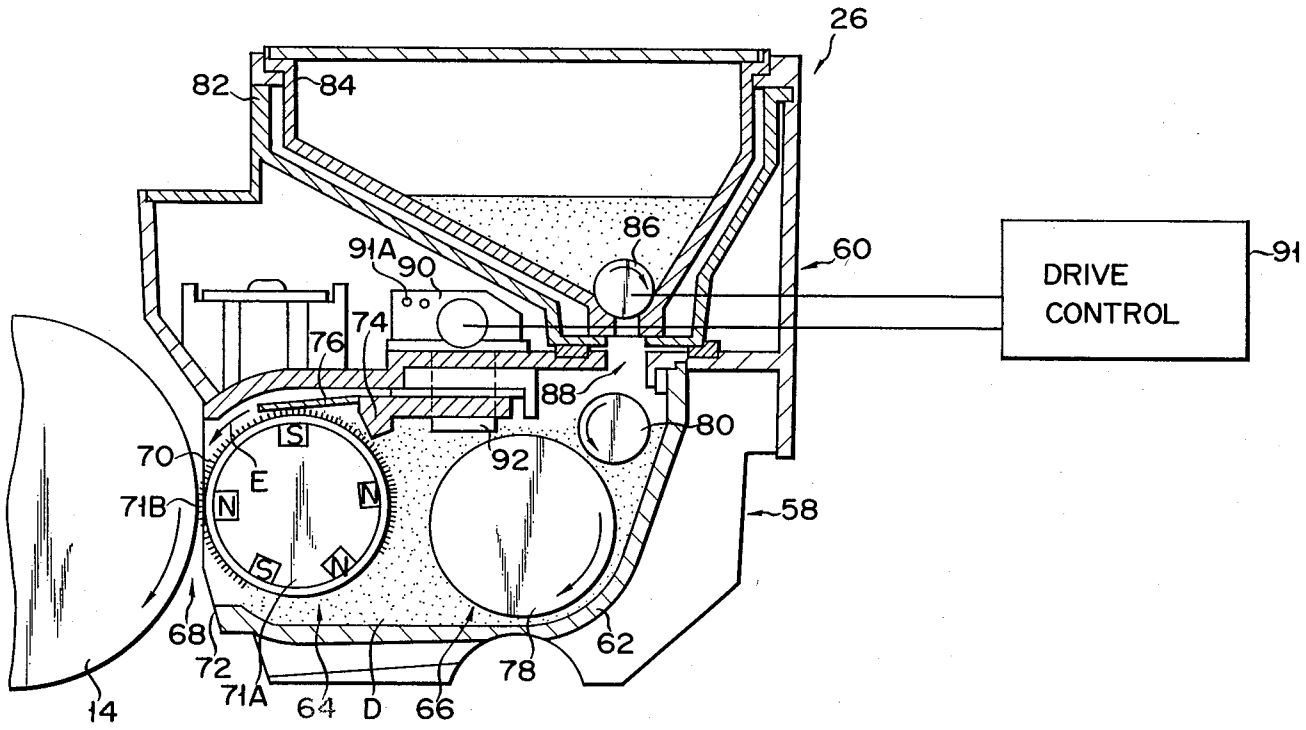
FIG. 2 is a schematic sectional view showing an operating state of the developing device of FIG. 1.

Referring now to FIG. 2, developing device 26 will be described in detail. It comprises stirrer unit 58, for stirring the developing agent and feeding the toner to photosensitive drum 14, and replenishing unit 60, located over unit 58 and adapted to resupply the toner to unit 58.

Stirrer unit 58 includes developing-agent feeder section 64 for feeding the developing agent in casing 62 to photosensitive drum 14, and developing-agent stirring section 66 for mixing the toner, supplied from replenishing unit 60, with the developing agent in casing 62 and stirring the resulting mixture. Section 64 is provided with developing roller 70 for forming a magnetic brush of the developing agent, on the peripheral surface of drum 14, and transporting the brush to developing region 68, which faces drum 14. Roller 70 is formed of magnetic roll 71A having five pole portions, and rotating sleeve 71B fitted on roll 71A and rotating in a counterclockwise direction, as indicated by an arrow in FIG. 2.

Rotating sleeve 71B is in a so-called "with" mode such that it is rotated in the same direction as the rotating direction of photosensitive drum 14, for development. Thus, the developing-agent brush, held on the surface of sleeve 71B, is in sliding contact with the image on drum 14, following the flow of the image. Thus, a sufficient developing time can be secured, and the electrostatic latent image, formed on drum 14, can enjoy high quality.

Corresponding to developing region 68, opening 72 is formed in casing 62. Doctor blade 74 is located over developing roller 70, whereby the thickness of the magnetic brush is regulated. From the tip end of blade 74 extends thin plate 76, which levels the brush, regulated by blade 74.

Stirring section 66 adjoins developing-agent feeder section 64. Section 66 includes main stirring roller 78 and sub-roller 80 located above roller 78. The developing agent is dropped from replenishing unit 60 onto subroller 80.

Replenishing unit 60 is fitted with toner hopper 84, which is removably mounted on top portion 82 of casing 62. Feed roller 86 is disposed at the bottom of hopper 84, whereby the toner in the hopper is fed into stirrer unit 58. In response to the rotation of roller 86, the toner is taken out of hopper 84. In this case, the amount of toner delivered from hopper 84 is controlled in accordance with the rotation of roller 86. Passage 88 is formed under roller 86. Units 58 and 60 connect with each other by means of passage 88, so that the toner drops from hopper 84 onto sub-roller 80 through passage 88. Further, replenishing unit 60 contains toner-content detector 90, which detects the toner content of the developing agent in stirrer unit 58. Detector 90 is connected to drive control 91 for controlling the drive of feed roller 86. Moreover, detector 90 is provided with indicating lamp 91A, which glows when the developing agent content is within an allowable range of error.

Content detector 90 determines the toner content of the developing agent by measuring the permeability of the developing agent. Since the developing agent is formed of a magnetic carrier and the toner is a nonmagnetic substance, the permeability of the agent varies, depending on the toner density. More specifically, magnetic sensor head 92 is immersed in the developing agent in stirrer unit 58, thus detecting a change of the permeability. The permeability change is converted into a change of voltage, and the toner content corresponding to the voltage change is detected.

When emptied, toner hopper 84, which is of a cartridge type, is replaced with a new one, full of toner.

Figure 3:
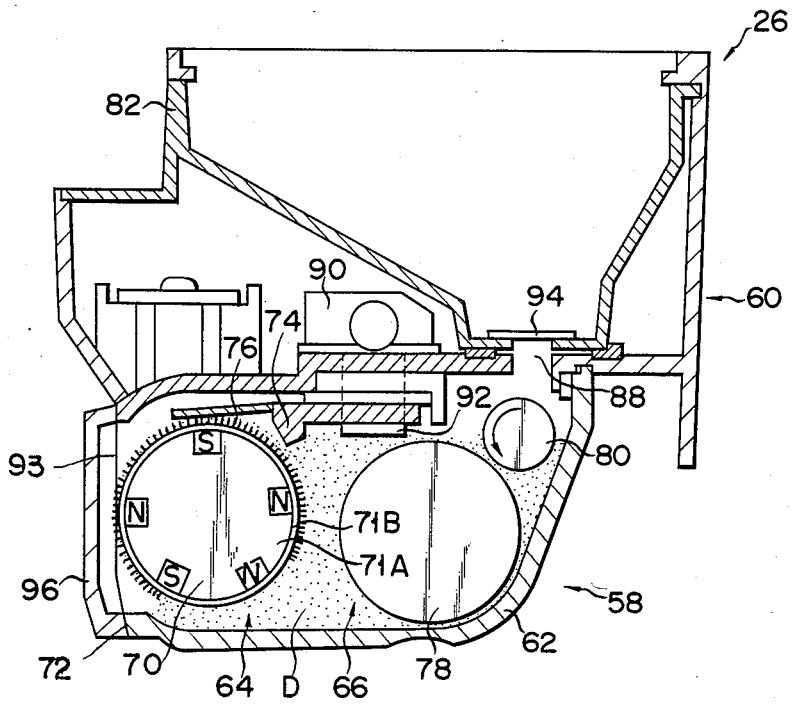
FIG. 3 is a schematic sectional view showing the developing device ready for packing.

Referring now to FIG. 3, there will be described the process in which developing device 26 is packed and shipped from the factory.

Prior to the shipment, developing device 26 is subjected to auto-toner adjustment at the factory, and developing agent D used in the adjustment is stored in stirring section 66. In the auto-toner adjustment, toner-content detector 90 is regulated so that the toner content of the developing agent in stirrer unit 58 is constant. If the content is reduced below a predetermined level, a drive signal is delivered to drive control 91. Thereupon, control 91 drives feed roller 86 for a predetermined angle of rotation, thereby supplying the toner from hopper 84. Thus, developing agent D is a standard one (adjusted toner) which is used directly in the adjustment of content detector 90, at the factory.

In packing developing device 26, toner hopper 84 is removed from replenishing unit 60, and seal 94 is pasted on the opening portion of resupply passage 88, thereby sealing the top of stirrer unit 58. Cover 96 is attached to opening portion 93, where opening 72 is formed in feeder section 64 of unit 58. Thus, unit 58 is closed hermetically by seal 94 and cover 96, so that developing agent D in unit 58, previously adjusted to a predetermined toner content, is prevented from being shaken off, during the transport of the developing device.

Figure 4:
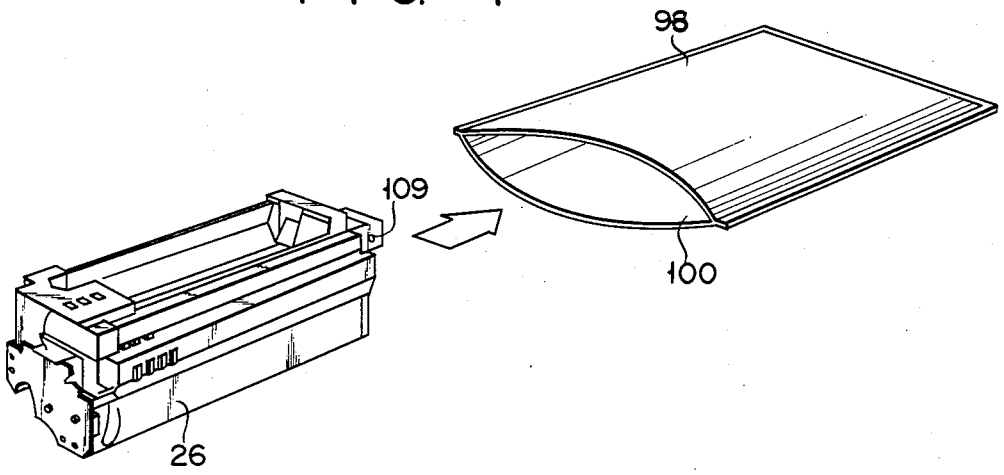
FIGS. 4 and 5 are perspective views illustrating the manner of packing the developing device.
Figure 5:
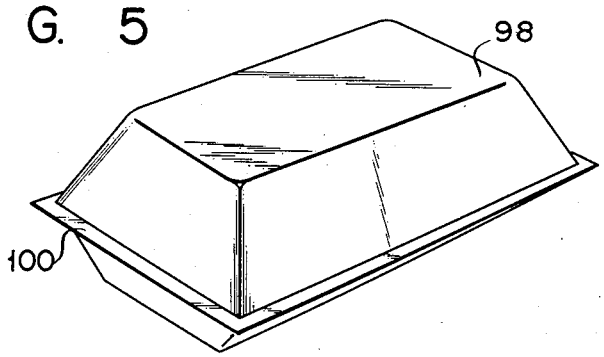
Figure 6:
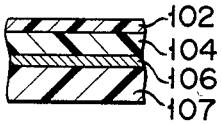
FIG. 6 is a sectional view of a moisture-proof bag shown in FIG. 4.

As shown in FIGS. 4 and 5, sealed developing device 26 is put in moistureproof bag 98, whose opening portion 100 is heat-sealed. As shown in FIG. 6, bag 98 is formed of a laminate structure, in which nylon sheet 102, polyethylene sheet 104, aluminum foil 106, and polyethylene sheet 107, are stacked from outside to inside, in layers.

Figure 8:
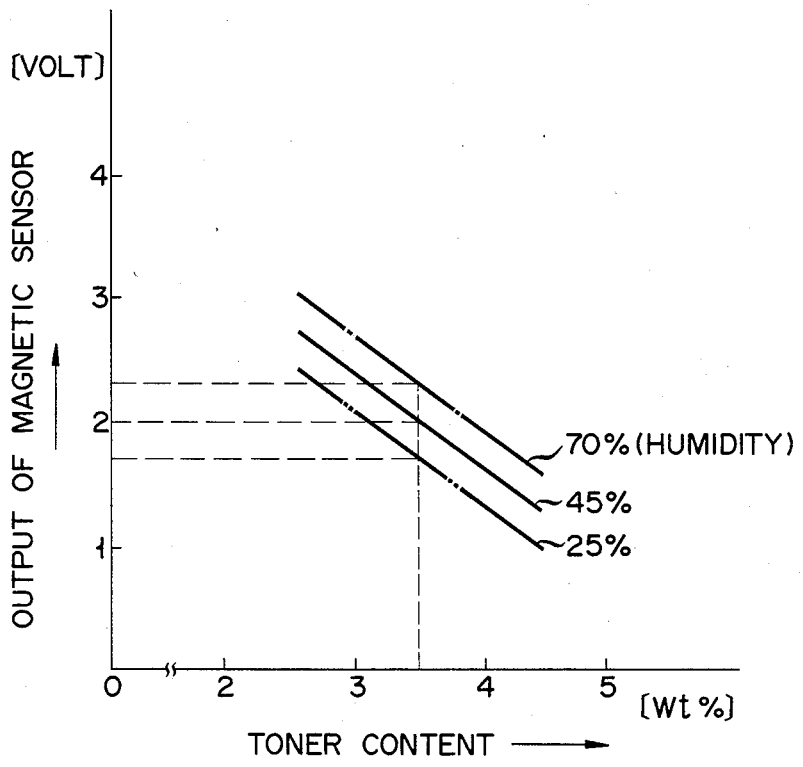
FIG. 8 is a graph showing the relationship between the output of a magnetic sensor and the toner content of a developing agent at various humidities.

Thus, developing agent D is kept at initial humidity (about 45%) by moistureproof bag 98, so that its properties are prevented from being changed by a change of humidity. Conventionally, the fluidity of developing agent D varies with a humidity change, so that the contact of agent D on magnetic sensor 90 may sometimes change. FIG. 8 shows influences of humidity on the relationship between the toner content and the output of the magnetic sensor. In FIG. 8, the axes of abscissa and ordinate represent the toner content (% by weight) and the sensor output (volt), respectively. In this graph, a full line indicates a measured value obtained at a humidity of about 45%; a dashed line, a value at 70%, and a two-dot chain line, at 25%. The sensor output, which is set to 2 volts with a 5% toner content, by weight, at normal humidity (45%), changes inevitably to 2.3 volts at high humidity (70%), and to 1.7 volts at low humidity (25%), as indicated by broken lines in FIG. 8. According to this embodiment, however, the humidity of the developing agent in developing device 26 can be prevented from changing, by sealing the agent in moisture-proof bag 98. Thus, output errors of the magnetic sensor in the toner content detection can be eliminated, so that the detected value is always correct.

Developing agent D will now be described more specifically. It is a mixture of toner and carrier. In this embodiment, a ferrite-based material is used for the carrier. As is generally known, there are two types of carriers; iron powder carriers ($Fe_2O_3$) and ferrite-based carriers ($Fe_3O_4$). The latter are less liable to oxidize or rust than the former. When sealing developing agent D in developing device 26, at the time of packing, for prolonged storage, therefore, the ferrite-based carriers can be used advantageously, for higher stability of the properties of agent D.

Table 1 shows the susceptibility of the carriers of the aforesaid two types to magnetization, in terms of the maximum magnetization, for comparison. As shown in Table 1, the maximum magnetization intensity of the ferrite-based carrier is less than that of the iron powder carrier; the former is less susceptible to magnetization than the latter. Accordingly, when storing the developing agent in developing device 26, which contains therein developing roller 70, as a magnet roller, the magnetic properties of the ferrite-based carrier are less liable to change than those of the iron powder carrier.

In this embodiment of the present invention, therefore, the ferrite-based carrier material is used for the carrier.

TABLE 1

| Carrier | Maximum Magnetization | Measurement Method |
|---|---|---|
| Ferrite-based carrier | 40 to 60 emu/g (5,000 0 e) | VSM method |
| Powder iron carrier | 190 to 21 emu/g (5,000 0 e) | |

The values of the maximum magnetization in Table 1 were measured in a magnetic field of 5,000 oersteds, by the VSM method. VSM is an abbreviation of vibration sample magnetometer. In this method, the magnetic properties are measured by the magnetomotive force of a sample, which is caused by vibrantly passing the sample through a magnetic field, having a magnetic gradient.

The operation of the aforementioned arrangement will now be described. First, the auto-toner adjustment of developing device 26 is performed at the factory, in the aforesaid manner. Then, seal 94 is pasted on the opening portion of resupply passage 88, at the bottom of replenishing unit 60, and cover 96 is attached to opening portion 93 of stirrer unit 58 of device 26, as shown in FIG. 3. In this case, developing agent D, used in the auto-toner adjustment, is kept stored in unit 58. Subsequently, developing device 26, loaded with developing agent D, is put into moisture-proof bag 98, and the bag is then sealed. Thereafter, device 26 in bag 98 is packed together with the body of copying machine 10.

After unpacking copying machine 10 and developing device 26 in moisture-proof bag 98, device 26 is taken out from bag 98, and seal 94 and cover 96 are removed from device 26. Then, toner hopper 84 is set in replenishing unit 60, and device 26 is mounted in housing 12 of machine 10.

Figure 7:
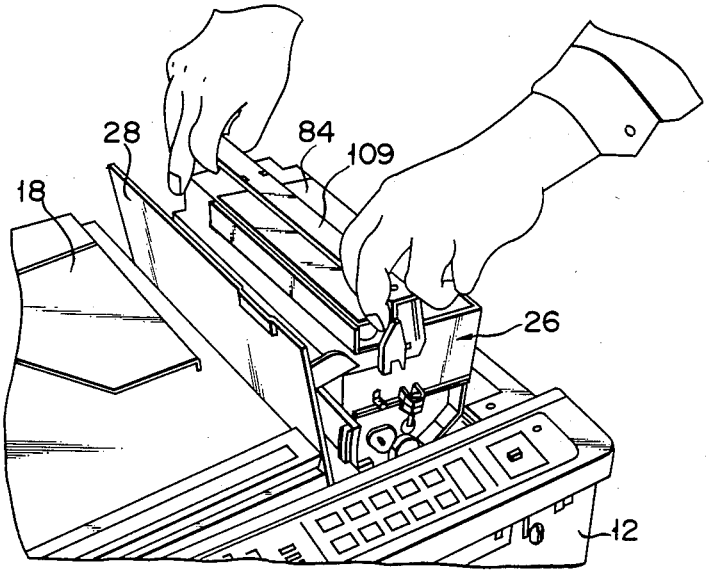
FIG. 7 is a perspective view illustrating the way the developing device is set in a copying machine, as the image forming apparatus.

In doing this, the operator lifts lid 28, at the top of housing 12 of copying machine 12, and inserts developing device 26 into housing 12, holding handle 109 of the device, as shown in FIG. 7.

When a power switch (not shown) is turned on, thereafter, the normal initial operation is performed, whereupon the copying machine is ready for a copying operation.

Thus, according to the embodiment of the present invention, the developing agent used in the auto-toner adjustment, prior to the shipment from the factory, is previously sealed in the developing device, before the device is packed together with the copying machine body. After the device and the machine body are unpacked, therefore, the auto-toner adjustment, which has conventionally been required at this point in time, need not be performed. Since the user need not be engaged in the auto-toner operation, adjustment errors can be avoided. After the unpacking work, moreover, the developing device is sealed in the moisture-proof bag, so that it can be cut off completely from moisture. Thus, the properties of the developing agent can be prevented from being changed by moisture, before the developing device is unpacked. Since the bag is closed hermetically by heat-sealing, moreover, the developing agent cannot be spilled from the developing device by vibration during transport.

It is to be understood that the present invention is not limited to the embodiment described above, and that various changes and modifications may be effected therein by one skilled in the art without departing from the scope or spirit of the invention.

In the above embodiment, for example, the content detector, used to detect the toner content of the developing agent, is designed so as to measure the magnetism of the developing agent. Alternatively, however, the detector may be formed of an optical sensor for optically detecting the toner content. The content detector of this type has a rotating probe disk, located above the developing roller. Only the toner of the developing agent is made to adhere to the peripheral surface of the disk. Then, a light is projected on the disk surface, and the reflected light from the surface is detected. Since the quantity of the reflected light varies, depending on the amount of the toner on the peripheral surface of the disk, the toner content is determined by the variation of the reflected light quantity. In this case, therefore, an accurate detection cannot be accomplished if a light sensing element, or other element used to receive the reflected light, is soiled. After the shipment from the factory, the light receiving surface of the sensing element, in the content detector according to the present invention, may sometimes be soiled by the developing agent, spilled by vibration during transport, or the like. According to the invention, however, the toner content is adjusted before the packing, at the factory, so that the auto-toner adjustment is not required after the machine and device are unpacked. Thus, the soiled detector cannot result in a wrong auto-toner adjustment.

What is claimed is:

1. A developing device which supplies a toner to an image carrier, having an electrostatic latent image thereon, thereby developing the latent image, comprising:

a casing stored with a developing agent containing the toner and a carrier at a predetermined ratio, said casing having a feed port through which the developing agent is fed to the image carrier;

automatic toner-content adjusting means for keeping the toner content of the developing agent, in the housing, constant, said adjusting means including content detecting means, adapted to detect the toner content of the developing agent and deliver a detection signal, and replenishing means for resupplying the toner, so as to maintain a preset toner content, in response to the detection signal from the detecting means; and sealing means for hermetically sealing the feed port of the casing, after the casing is loaded with the developing agent used in setting the automatic toner-content adjusting means to the preset toner content, so as to keep the density of the developing agent constant.

2. A device according to claim 1, wherein said content detecting means includes an indicating lamp for giving an indication that the detected toner content is within an allowable error range from the preset value.

3. A device according to claim 1, wherein said replenishing means is stored with the toner only, and includes a package removably mounted over the casing.

4. A device according to claim 3, wherein said casing has an opening through which the toner is supplied from the package, said opening corresponding to the mounting position of the package, and sealed with a sealing material.

5. A device according to claim 1, wherein said developing agent is formed of a nonmagnetic toner and powdered magnetic material, as a carrier.

6. A device according to claim 5, wherein said carrier is formed of a ferrite-based material.

7. A device according to claim 5, wherein said content detecting means includes a magnetic sensor, and detects the toner content of the developing agent by measuring the permeability of the developing agent.

8. An image forming apparatus for forming an image on a paper sheet, comprising:

a housing including a mechanism, adapted to apply a toner to an image carrier, having an electrostatic latent image thereon, thereby developing the latent image, and to transfer the developed image to the paper sheet;

a developing unit formed independently of the housing, and adapted to be attached, in use, to the housing, so that a developing agent is fed to the image carrier, through a feed port in a casing, said developing unit including content detecting means, adapted to detect the toner content of the developing agent and deliver a detection signal, and adjusting means adapted automatically to resupply the toner, thereby adjusting the toner content, in response to the detection signal, when the toner content falls below a predetermined value, said developing unit being loaded with the developing agent adjusted to the predetermined toner content, said feed port being hermetically sealed, so as to keep the density of the developing agent constant.

9. An apparatus according to claim 8, wherein said developing agent is formed of a nonmagnetic toner and powdered magnetic material, as a carrier.

10. An apparatus according to claim 9, wherein said content detecting means includes a magnetic sensor, and detects the toner content of the developing agent by measuring the permeability of the developing agent.

11. An apparatus according to claim 9, wherein said carrier is formed of a ferrite-based material.

12. An apparatus according to claim 8, wherein said content detecting means includes an indicating lamp for giving an indication that the detected toner content is within an allowable error range from the preset value.

13. An apparatus according to claim 8, wherein said replenishing means is stored with the toner only, and includes a package removably mounted over the casing.

14. An apparatus according to claim 13, wherein said casing has an opening through which the toner is supplied from the package, said opening corresponding to the mounting position of the package, and sealed with a sealing material.

15. A method for packing a developing device, which supplies a toner, through a feed port formed in a casing, to an image carrier, having an electrostatic latent image thereon, thereby developing the latent imamge, comprising steps of:

detecting the toner content of a developing agent, and setting a control toner content for an automatic toner-content adjuster, adapted to resupply the toner in response to a detection signal, said content setting process using a standard developing agent, previously adjusted to a predetermined toner content; and hermetically sealing the feed port of the casing, with the standard developing agent stored in the casing, so as to keep the density of the developing agent constant.

* * * * *